US006327757B1

(12) United States Patent
Noda

(10) Patent No.: US 6,327,757 B1
(45) Date of Patent: Dec. 11, 2001

(54) METHOD OF OPERATING PLASTIC CLIP, AND PLASTIC CLIP USING SAME METHOD

(75) Inventor: Taizoh Noda, Nishinomiya (JP)

(73) Assignee: J-Sen Limited, Kyoto (JP)

( * ) Notice: Subject to any disclaimer, the term of this patent is extended or adjusted under 35 U.S.C. 154(b) by 4 days.

(21) Appl. No.: 09/627,322

(22) Filed: Jul. 27, 2000

(30) Foreign Application Priority Data

Oct. 6, 1999 (JP) ..... 11-285980

(51) Int. Cl.[7] ..... A44B 21/00
(52) U.S. Cl. ..... 24/504; 24/499
(58) Field of Search ..... 24/499, 503, 504, 24/515, 516

(56) References Cited

U.S. PATENT DOCUMENTS 4,489,466 * 12/1984 Bakker ..... 24/516 X
5,400,483 * 3/1995 Noda ..... 24/499
5,778,497 * 7/1998 Noda ..... 24/504
6,260,244 * 7/2001 Noda ..... 24/499

* cited by examiner

*Primary Examiner*—Anthony Knight
*Assistant Examiner*—Ruth C. Rodriguez
(74) *Attorney, Agent, or Firm*—Snider & Associates; Ronald R. Snider

(57) ABSTRACT

A compact plastic clip has a recessed auxiliary plate (23) in an upper clipping member (21) which is inserted into a fitting window (5) in a lower clipping member (1). A horizontal bar portion (27) is placed on a support shelf (6), and an axis receiver (46) of an operation member (41) is fitted into an axis support (8) formed in a side wall (4) of the lower clipping member (1) and when it is forcibly pressed downward, both the ends of the lower and upper members (1,21) are pinched together by the elastic power of a plastic material for a closed position, while when the rear area of the operation member (41) is moved upward, a contacting surface (28*a*) of a projection (28) is pressed forcibly toward the rear at a bottom end (47*a*) of a first actuation cam (47), so that this action causes an open position between the lower and upper clipping members thereof by the force of a fulcrum function of the horizontal bar portion (27).

7 Claims, 19 Drawing Sheets

METHOD OF OPERATING PLASTIC CLIP, AND PLASTIC CLIP USING SAME METHOD

RELATED APPLICATION

This present disclosure claims the priority of Japanese Patent Application Number 11-258980 (filed on Oct. 6, 1999) which is incorporated herein by reference in its entirety.

BACKGROUND OF THE INVENTION

1. Field of the Invention

This invention relates to a plastic clip, for example, a clip used on clothes such as suspender clips or a clip attached on the leading end of a waist cloth for closing a Kimono, or clothes pin.

2. Descriptions of the Prior Art

The present inventor has already obtained the following two U.S. patents based on the similar conceptions:

(1) U.S. Pat. No. 5,400,483, and (2) U.S. Pat. No. 5,778,497

U.S. Pat. No. 5,400,483 discloses a plastic clip, wherein metallic pins or metallic springs are not adopted. Instead of pins and springs, an elastic plastic material is utilized. As shown in FIG. 18A and FIG. 18B as Prior Art, this clip is opened or closed when top ends of a lower clipper member (61) and an upper clipper member (62) are operated by an operation member (63). A support shelf (64) is formed at a rear portion of the lower clipper member (61), while a hinge (65) is also formed at a rear portion of the upper clipper member (62). A cam plate (66) is provided on the operation member (63), whereas, when both rear portions of the lower clipping member (61) and the upper clipper member (62) are combined together crossing like the letter X, and the cam (66) is pinched between the crossing portion and the rear portion. Thus, the hinge (65) is adapted to engage onto the supporting shelf (64) at a fixed pressure force, so that the top ends of the lower clipping member (61) and the upper clipping member (62) may be opened by elastic force of plastic material.

U.S. Pat. No. 5,778,497 discloses another plastic clip, wherein the minimum thickness of the clip is attained and at the same time the pressure submission toward each locking material is ensured. As shown in FIG. 19A and FIG. 19B as another example of Prior Art, an upper clipping member (71) comprises a mouth (67) prepared on an upper surface of rear portion, a side wall (68) formed on bottom surface of a rear portion, a spindle plate (69) established in the forward portion of the side wall (68), and a recess bearing (70) prepared on the inside surface of the side wall (68). A lower clipping member (76) comprises a ditch-like bearing (72) on bottom surface of a rear portion, a narrow projection (74) having protuberance (73) on both sides of the rear portion formed, and an elastic tongue (75) extending upward formed on the central portion. An operation member (83) comprises an actuation expansion (79) formed on outer surface of an outer side wall (77) of a box (78) having the outer side wall (77). This actuation expansion (79) is adapted to fit between the side wall (77) and the projection (74), an engaging dent (80) into which the protuberance (73) fits and a pressure plate (81) provides a small at position to the rear of the centre of the actuation expansion (79), and a slit-like belt insertion (82) is prepared at the end portion.

The plastic clip developed by U.S. Pat. No. 5,400,483 has a defect in that the shape of the operation member (63) is easily worn and is not durable.

The plastic clip developed by U.S. Pat. No. 5,778,497 has improved durability and locking power, but it is still necessary to offer a better quality and long-lasting clip for the market. Also, the exterior of the clip is unattractive due to the combination between the upper clipping member, the lower clipping member and the operation member.

SUMMARY OF THE INVENTION

The objective of the present invention is to provide a better quality plastic clip after resolving various problems existing in prior art. The inventor deligently worked on the design, and performed experiments. As a result, a novel plastic clip was developed in the following manner:

The construction of rear portions was changed and a combination method for connecting an upper clipping member and a lower clipping member as well as adopting a novel constitution for an operation member. The plastic clip of this invention is furnished with an ensured pressuring force by the operation member for pinching the upper clipping member and the lower clipping member. At the same time, when the upper and lower clipping members are in a closed position, an actuation cam prepared on the operation member does not affect a rear wall of the upper clipping member which acts as a reaction bar, and thus hysteresis wear of the rear wall is avoided, so that the durability is increased.

This invention comprises a method of operating a plastic clip

A method of operating a plastic clip having a lower clipping member, an upper clipping member and an operation member, which comprises:

providing a recessed auxiliary plate prepared in the upper clipping member;

providing a fitting window prepared in the lower clipping member;

inserting the upper clipping member into the fitting window;

providing a horizontal bar portion to be placed on a support shelf;

providing an axis receiver in the operation member;

providing an axis support formed in a side wall of the lower clipping member;

fitting the axis receiver into the axis support; and wherein when the receiver is forcibly pressed downward, both the ends of the lower and upper clipping members are pinched together by the elastic power of a plastic material for a closed position while when the rear area of the operation member is moved upward and a contacting surface of a projection is pressed forcibly toward the rear at a bottom end of a first actuation cam, an open position is caused between the lower and upper clipping members thereof by the force of a fulcrum function of the horizontal bar portion.

This invention also comprises a plastic clip:

A plastic clip having a lower clipping member (1), an upper clipping member (21) and an operation member (41), the clip comprising:

the lower clipping member (1) on which an upper clipping member (21) is placed, and an operation member (41) which is assembled with the upper clipping member (1), wherein both end portions of the lower clipping member (1) and the upper clipping member (21) are opened or closed by movement of the operation member (41);

a pair of side walls (4) facing each other on a rear area of the lower clipping member (1);

a rear wall (5) having a support shelf (6) established in a rear wall of a rear area;

a fitting portion formed on inner surfaces of the side walls (4) and in front of the support shelf (6), wherein the operation member (41) may move up and down in the fitting portion;

a recessed auxiliary plate (23) established on a rear area of the upper clipping member (21);

a rear wall of the recessed auxiliary plate (23) formed in a horizontal bar shape portion (27) placed on the support shelf (6);

a plane surface portion (7) formed on a front part of the horizontal bar shape portion (27);

a receiver portion axis receiver (46) for accepting a fitting portion formed in front and upper portion of the operation member;

the receiver portion (46) assembled with the fitting portion;

wherein the lower clipping member (1) and the operation member (41) are aligned into a same direction;

a first actuation cam (47) formed in an extending shape, which is adapted to press the plane surface portion rearward behind a rotation center for the operation member (41);

a second actuation cam (48) formed in an extending downward shape, which is adapted to press an upper surface of the recessed auxiliary plate (23) downward in a lower portion than the rotation center;

a force which maintains a closing condition in the front area of the rotation center from the lower portion, when the second actuation cam (48) is positioned into just below the rotation center, where the cam (48) presses upper faces of the recessed auxiliary plate (23) downward so that both tops of the lower clipping member (1) and the upper clipping member (21) are closed; and another force which maintains an opening condition between each top of the lower clipping member (1) and the upper clipping member (21) by a counter force produced by the horizontal bar shape portion (27) while the first actuation cam (47) presses the plane surface of the horizontal bar shape portion (27) backward, when the second cam (48) is positioned to stay in a rear area of the lower portion and the first cam (47) is positioned to stay in upper area between the rotation center and the horizontal bar shape portion.

The present invention also provides the support axis (8) between the walls (4) of the lower clipping member (1), while the arcuate axis receiver (46) is provided over on the upper surface of the front wall of the back plate (44).

This invention further provides a gap between the first actuation cam (47) and the contacting surface (28*a*) during the closing time between the lower clipping member (1) and the upper clipping member (21) so that this gap may attain to avoid the hysteresis wear of the horizontal bar portion (27) to be caused by mutual friction.

DESCRIPTIONS OF THE PREFERRED EMBODIMENT

Figure 1A:
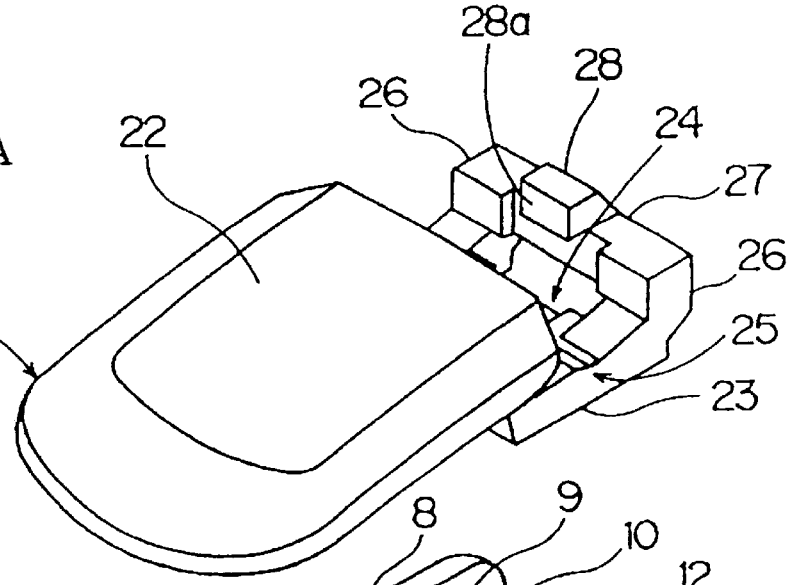
FIG. 1A is an exploded perspective view of an upper clipping member developed by this invention FIG. 1B an exploded perspective view of a lower clipping member.
Figure 1B:
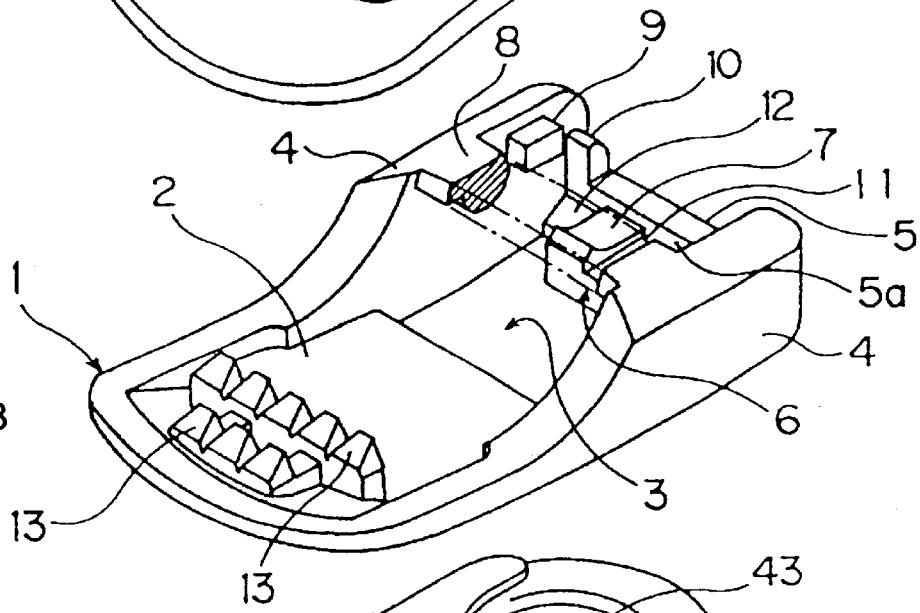
FIG. 1C is an exploded perspective view of a operation member.
Figure 1C:
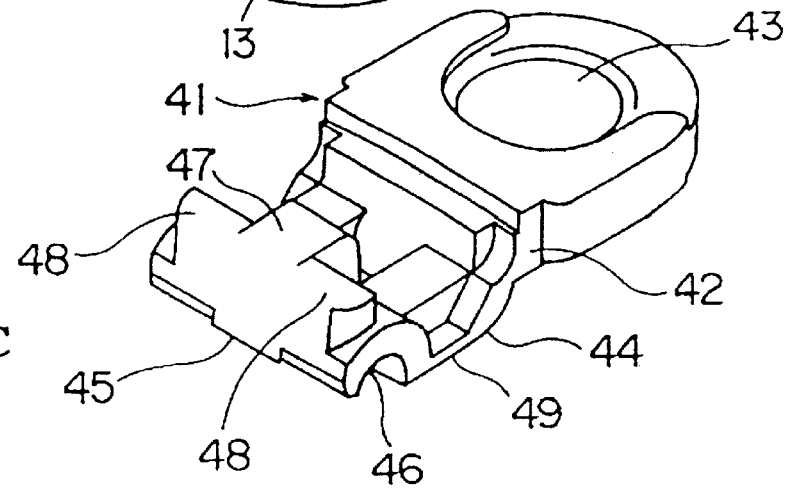

FIG. 1A, FIG. 1B and FIG. 1C show exploded perspective views of a plastic clip developed by the present invention. FIG. 1A shows an upper clipping member (21), and FIG. 1B shows a lower clipping member (1), while FIG. 1C shows an operation member (41). With regard to FIG. 1C, this figure represents the back side so that components may be seen clearly.

As shown in FIG. 1B, FIG. 2A, FIG. 2B, FIG. 2C, FIG. 3A and FIG. 3B, the lower clipping member (1) has a fitting window (3) in rear area of a lower substrate (2) which has a circular arch shaped toward its top end. On both sides of the window (3), a pair of side walls (4) is formed, while in its rear portion a rear wall (5) is formed lower than the side wall (4). A support shelf (6) is provided on a front surface (5*a*) of the rear wall (5), and on both sides of the support shelf (6) a pair of a plane surface (7), the top end of which is bent upward, is formed. On the position above the shelf (6) a pair of support axes (8) as a fitting portion is prepared horizontally on both inner surfaces of the side wall (4). In the inner surfaces of the side wall (4) positioned between the shelf (6) and the axis (8), a pair of projecting interference blocks (9) is established.

Figure 2A:
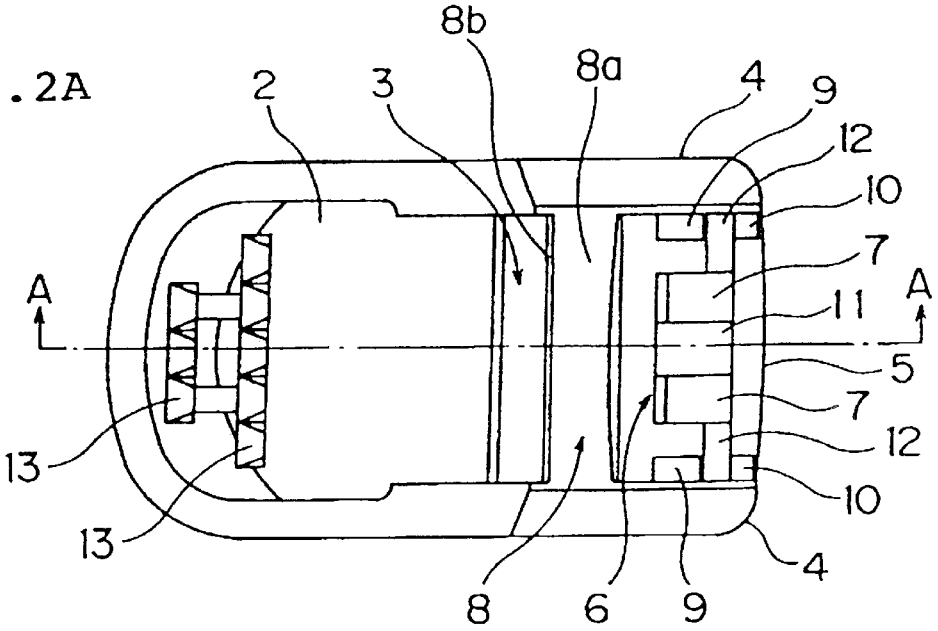
FIG. 2A is a plan view of the lower clipping member.
Figure 2B:
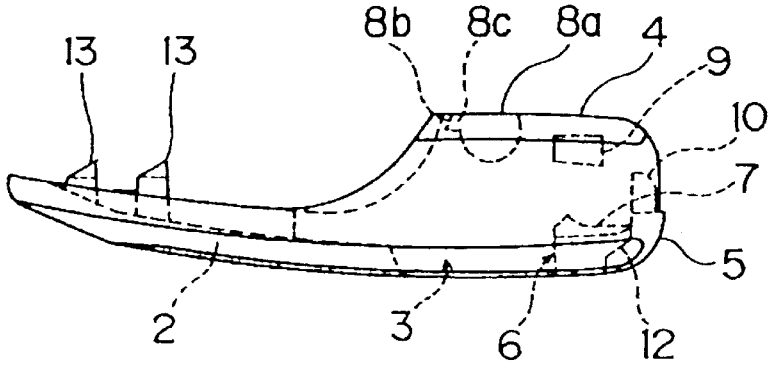
FIG. 2B is a longitudinal sectional view of the lower clipping member.
Figure 2C:
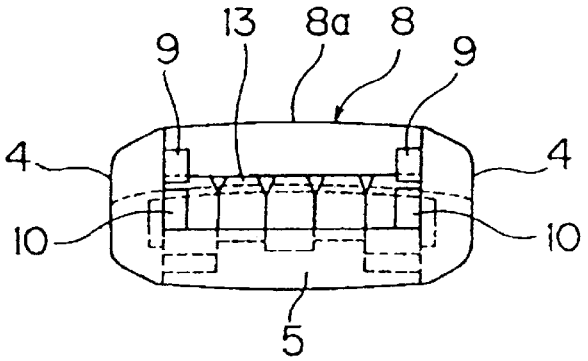
FIG. 2C is a rear elevational view of the lower clipping member.
Figure 3A:
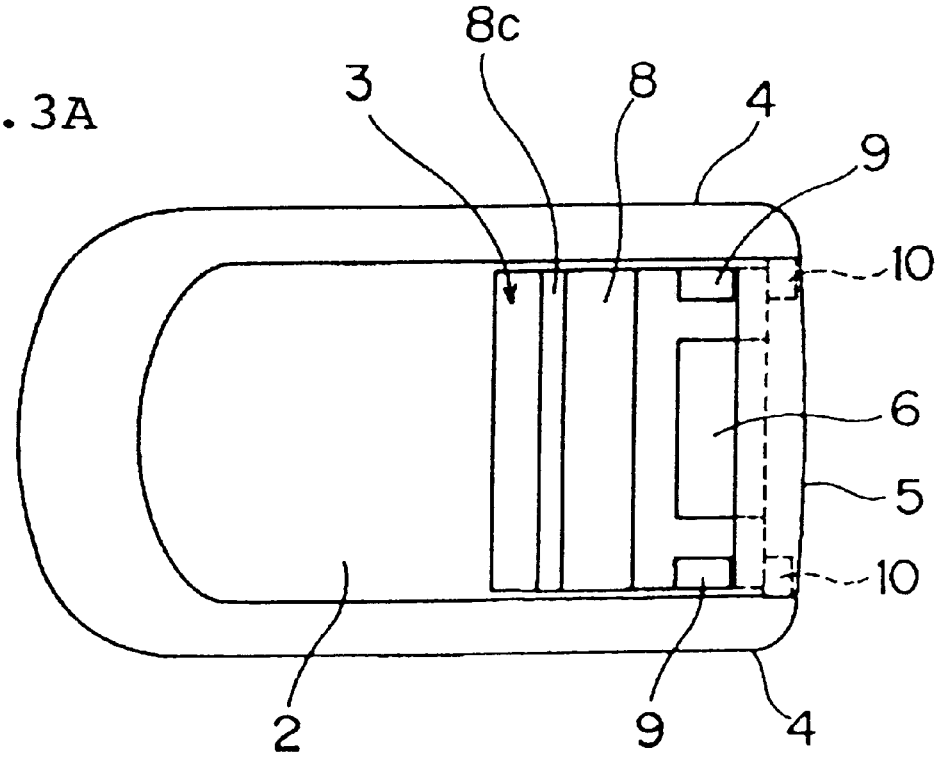
FIG. 3A is a bottom view of the lower clipping member.
Figure 3B:
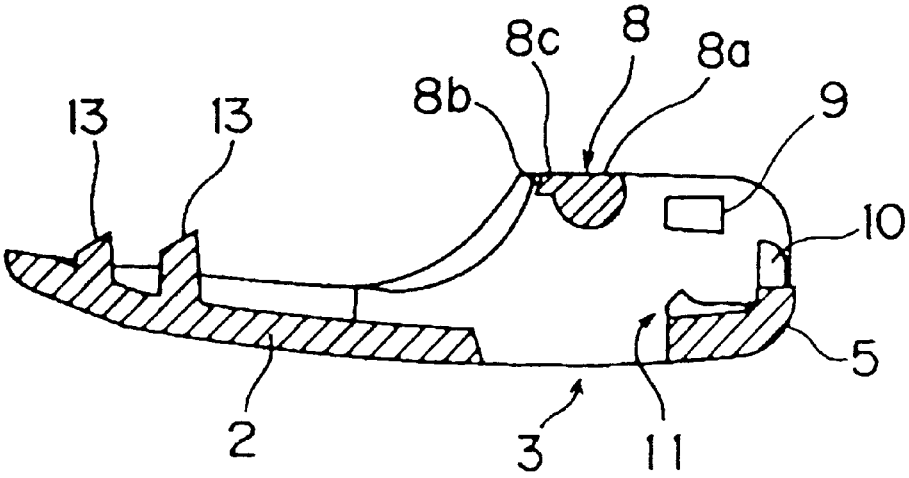
FIG. 3B is a longitudinal sectional view of the lower clipping member along the line A—A of FIG. 2A.

With reference to FIGS. 2A, 2B and 2C, the axis (8) has a flat surface (8*a*) which aligns with the side wall (4), and as shown in FIG. 3, the axis (8) has a jut (8*c*) with a front face (8*b*). On both sides of the rear wall (5) a pair of claws (10) is formed, while the height of the claw (10) is adapted to be lower than that of the interference block (9). Between the two plane surfaces (7) a ditch (11) is formed extending forward from the front surface (5*a*) as shown in FIG. 1B, and a pair of sloped shelves (12) is established between the side wall (4) and the support shelf (6), and the sloped shelf (12) runs down forward from the degree lower than the height of the shelf (6).

Teeth (13) are prepared for the lower clipping member (1) on front area of the substrate (2).

As shown in FIG. 1A, FIG. 4A, FIG. 4B, FIG. 4C, FIG. 5A and FIG. 5B, the upper clipping member (21) has a recessed auxiliary plate (23) in rear area of an upper substrate (22), and this plate (23) is adapted to be properly fitted into the window (3) of the lower clipping member (1). On both sides of a bottom (24) of the auxiliary plate (23), a pair of protuberances (25) is formed, while a pair of rear walls (26) of the auxiliary plate (23) stands on the bottom (24). Referring to FIG. 4A, FIG. 4B, FIG. 4C, FIG. 5A and FIG. 5B, these two standing walls (26) are connected by a horizontal bar portion (27) which has an arcuate face (27*a*) corresponding with the plane surface (7). On the middle surface of the horizontal bar portion (27) a flat projection (28) is equipped with a contacting surface (28*a*).

Figure 4A:
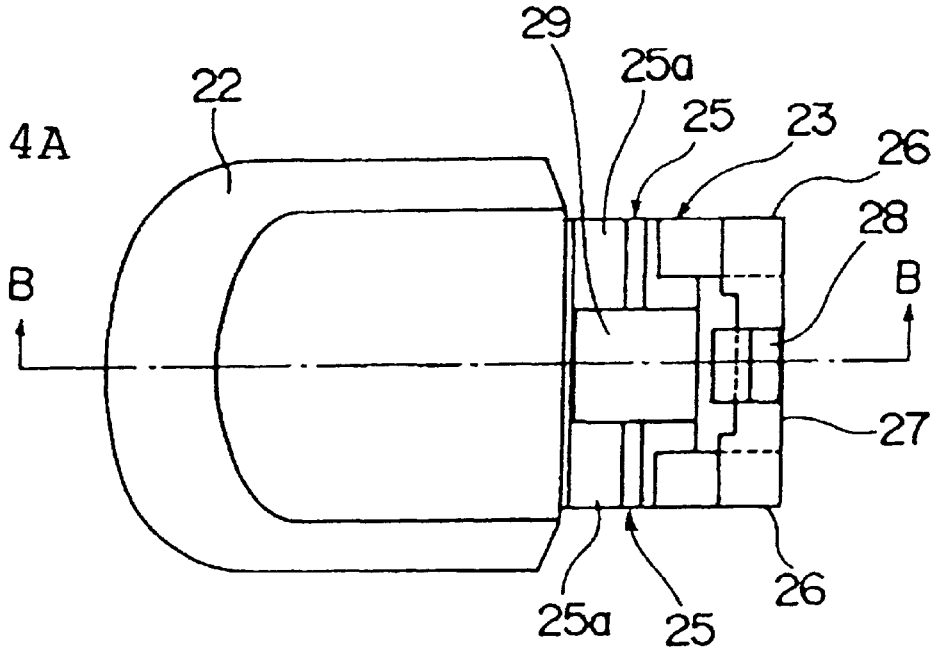
FIG. 4A is a plan view of the upper clipping member.
Figure 4B:
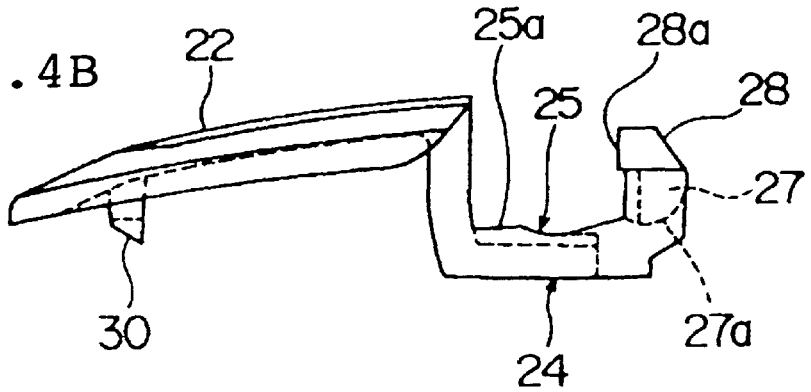
FIG. 4B is a side view of the upper clipping member.
Figure 4C:
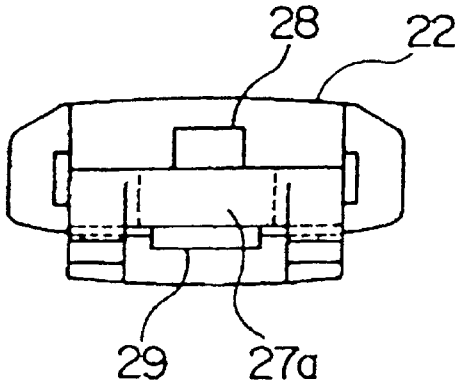
FIG. 4C is a rear view of the upper clipping member.
Figure 5A:
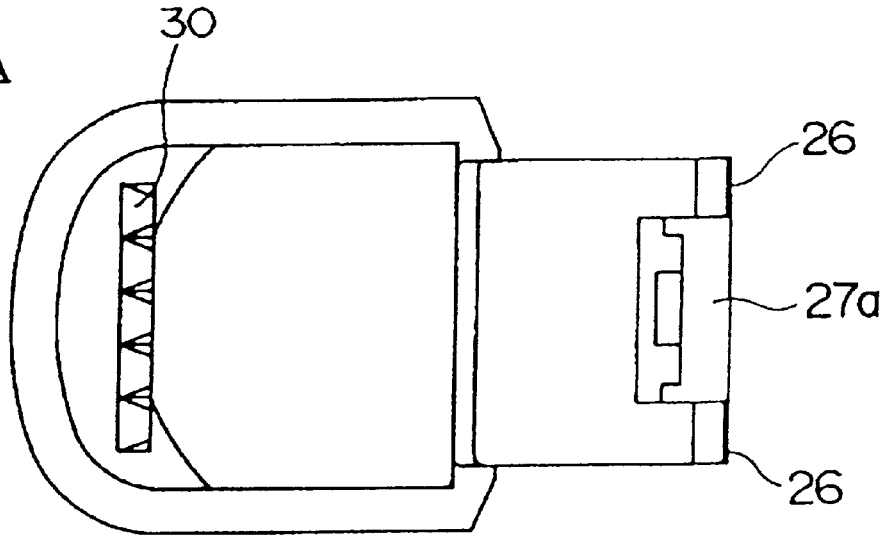
FIG. 5A is a bottom view of the upper clipping member.
Figure 5B:
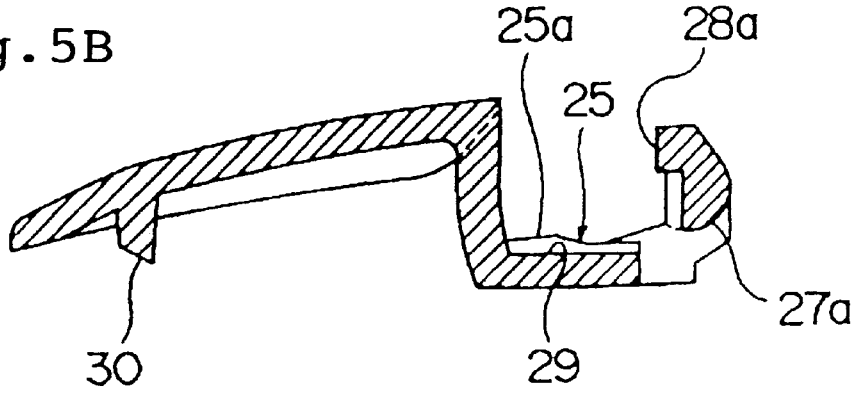
FIG. 5B is a longitudinal sectional view of the upper clipping member along the line B—B shown in FIG. 4A.

As shown in FIG. 4A and FIG. 4B, the protuberance (25) has a pair of upper platforms (25*a*), and a ditch portion (29) runs on the central portion of the bottom (24). The horizontal bar portion (27) offers a shape of a partially closed fan or a quarter circle as shown in FIG. 4B, the arcuate face (27*a*) which is directed downward. The width of the rear wall (26) is defined narrower than that of the sloped shelf (12), and the back side of the rear wall (26) is arranged in a shape to receive the upper surface of the sloped shelf (12) and the front face of the claw (10).

In FIG. 4B, the numeral 30 is teeth of the upper clipping member (21) which corresponded with the teeth (13) of the lower clipping member (1).

Figure 6A:
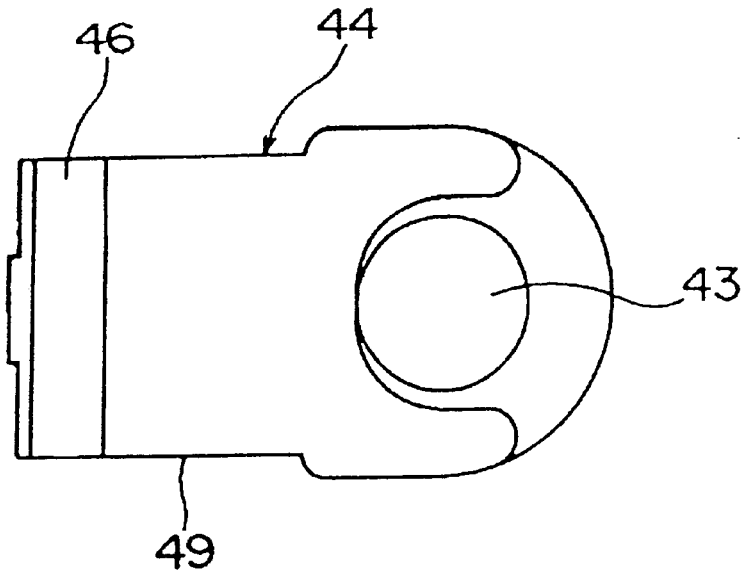
FIG. 6A is a plan view of the operation member
Figure 6B:
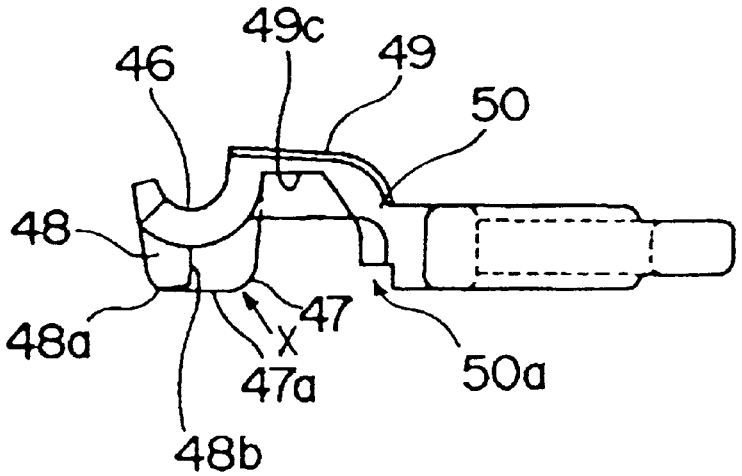
FIG. 6B is a side view of the operation member.
Figure 6C:
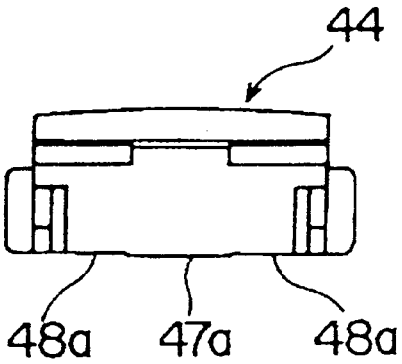
FIG. 6C is a front view of the operation member.
Figure 7A:
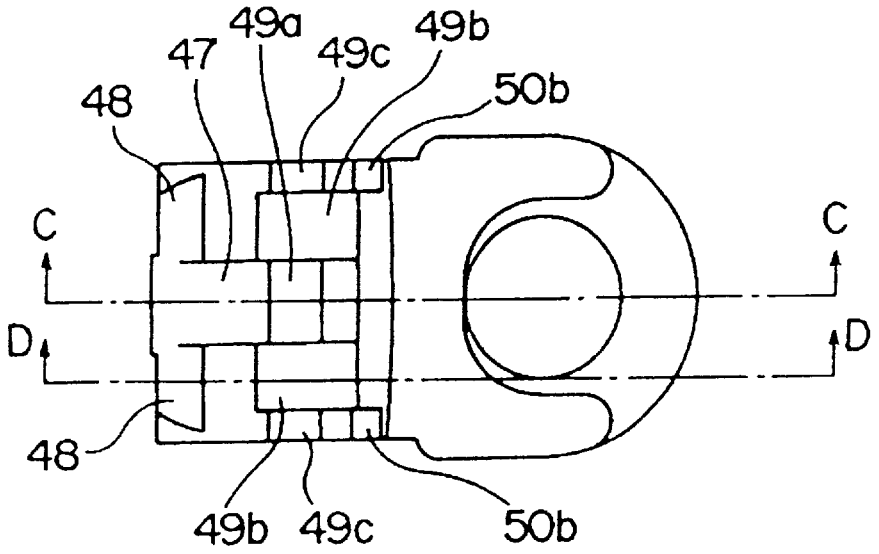
FIG. 7A is a bottom view of the operation member.
Figure 7B:
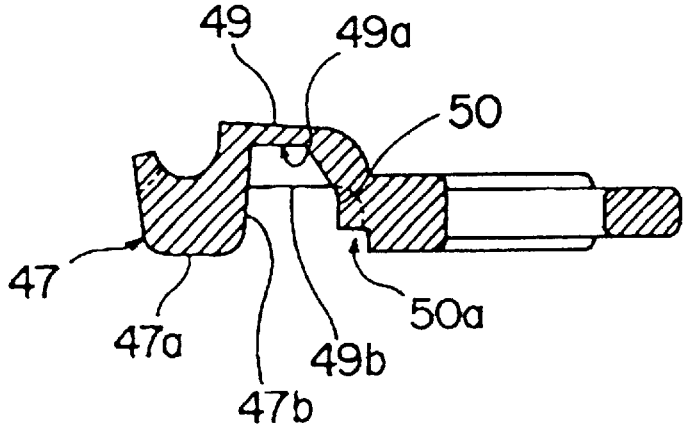
FIG. 7B is a longitudinal sectional view of the operation member along the line C—C shown in FIG. 7A.
Figure 7C:
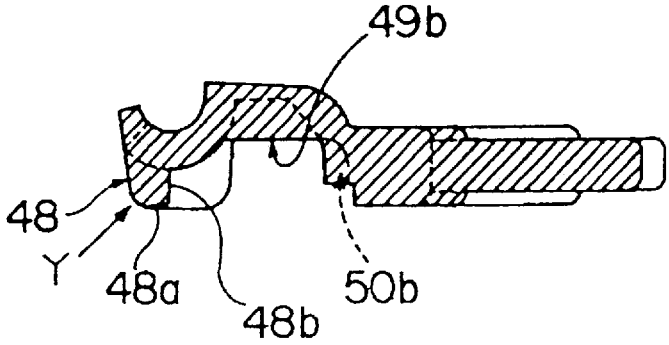
FIG. 7C is a longitudinal sectional view of the operation member along the line D—D shown in FIG. 7A.

With reference to FIG. 1C, FIG. 6A, FIG. 6B, FIG. 6C, FIG. 7A, FIG. 7B and FIG. 7C, the operation member (41) has a strap insertion hole (43) in the rear area of an operation substrate (42) which is shaped in a semi-circle. A back plate (44) is formed in the front area and it is adapted to be inserted between the side walls (4). On a front wall (45) of the back plate (44), an arcuate axis receiver (46) as a fitting receiver is formed and the receiver (46) is rotatably fitted with the support axis (8) of the lower clipping member (1). With reference to FIG. 6B and FIG. 6C, on the central portion below the front wall (45) a first actuation cam (47) is established so that the cam (47) includes a bottom end (47*a*) to forcibly contact the contact surface (28*a*) of the projection (28). On both sides of the first cam (47) a pair of second actuation cams (48) is established. The second cam (48) includes a bottom edge (48*a*) to forcibly contact the upper platform (25*a*) of the protuberance (25) of the upper clipping member (21) and also promotes a rear end (48*b*) to contact the interference block (9). With reference to FIG. 7A, FIG. 7B and FIG. 7C, a central portion (49*a*) of a middle plate (49) in the back plate is arranged in a hollowed shape so that the portion (49*a*) may correspond with the outer appearance of the projection (28), and both adjoining portions (49*b*) of the central portion (49*a*) are also arranged in the receiver shape so that these portions (49*b*) may correspond with the outer appearance of the horizontal bar portion (27). Both end portions (49*c*) of the middle plate (49) are also arranged in a convex shape so that the portions (49*c*) may correspond with the interference block (9).

As shown in FIG. 6A, FIG. 6B and FIG. 6C, below the rear wall (50), a one side ditch (50*a*) which corresponds with the upper surface of the other rear wall (5) is formed. With reference to FIG. 7A and FIG. 7C, both ends (50*b*) of the one side ditch (50*a*) are arranged in a curved and depressed receiver shape so that the ends (50*b*) may correspond with outer shape of the claw (10). The first actuation cam (47) has a flat lower surface wherein rear end of the front wall (46) is projecting and the cam (47) is also formed in a U-letter like from the top end to the rear end of the front wall (45). Accordingly, when the operation member (41) is aligned with the lower clipping member (1), as shown in FIG. 6B as a X-letter indication, the rear end of the front wall (45) is positioned behind the center of the support axis (8). The second actuation cams (48) divide the U-letter like first cam (47) in front and rear and they are arranged in a shape to have the two divided faces of the rear ends (48*b*). The front surface of the second cam (48) is adapted to be same width as the interference block and the surface forms a similar surface with the first cam (47). The side portions of the second cam (48) are chamfered in an arcuate shape so that the portions do not reach to the both ends of the axis receiver (46) of the bottom edges (48*b*). The under face of the second cam (48) is adapted to be slightly curved in the front end of the front wall (45). Accordingly, when the operation member (41) is aligned with the lower clipping member (1), as shown in FIG. 7C as a Y-letter indication, the front end of the front wall (45) which projects slightly is positioned in front of the center of the support axis (8).

The auxiliary plate (23) of the upper clipping plate (21) is arranged to be fitted with the fitting window (3). When the auxiliary plate (23) is pushed toward the lower part of the support axis (8) through the lower clipper member (1) and when the bottom (24) of the auxiliary plate (23) is positioned into the fitting window (3), the arcuate surface (27*a*) of the horizontal bar portion (27) contacts and rides on the plane surface (7) of the support shelf (6). The sizes of lower surfaces for the auxiliary plate (23) and of the lower surface for the side wall (4) are arranged together, the back surfaces of the rear walls (25) contact onto the upper surfaces of the sloped shelves (12) and onto the front surfaces of the claws (10) with a gap. Thus, the top ends of the both lower and upper clipping members (1 and 21) face each other, while the teeth (13 and 30 ) equipped with the both clipping members (1 and 21) are prearranged to mesh with each other.

In the condition that the lower clipping member (1) is assembled with the upper clipping member (21), the axis receiver (46) of the operation member (41) is inserted into the support axis (8) and the operation member (41) is turned round downward in the center of the support axis (8). The front end of the bottom end (47*a*) of the first actuation cam (47) is prearranged to contact onto the upper end of the projection (28). At the same time, the horizontal bar portion (27) is also prearranged to insert the front wall (45) into the auxiliary plate (23) in spite of the resistance caused by the horizontal bar portion (27). In order to overcome this resistance, this invention adopts the natural elasticity of plastic material itself. On the other hand, the thickness of the axis receiver (46) is defined at a little bit smaller than those of the support axis (8) and the interference block (9).

In the condition that all three members (1, 21 and 41) are assembled together, the first actuation cam (47) is prearranged to be fitted into the ditch portion (29). When the operation member (41) is rotated downward about the center of the support axis (8), the top ends of the bottom edges (48*a*) of the second actuation cam (48) are adapted to make their first contacts onto the protuberance (25). When the top ends of the edges (48*a*) stay at the lower position of rotation center, they ride on the upper platform (25*a*) of the protuberance and assist pressing down the auxiliary plate (23). By this movement, the top ends of the lower and upper clipping members (1 and 21) are closed to mesh together the teeth (13 and 30). When the top ends of the bottom edges (48*a*) move over the lower position of the rotation center, the upper platform is arranged to decline downward so that downward force is caused to maintain the pinching status.

In the condition that the operation member (41) becomes flat, the upper surface of the substrate (22), the flat surface (8*a*) of the support axis (8) and the upper surface of the middle plate (49) of the operation member (41) are all made even, while as shown in FIG. 7B a back surface (47*b*) of the first cam (47) is prearranged not to contact the contacting surface (28*a*) of the projection (28).

When the operation member (41) is rotated upward about the center of the support axis (8), a top end of the bottom edge (48*a*) of the second cam (48) contacts onto the protuberance (25) to press the auxiliary plate (23). Then, the rear end of the bottom end (47*a*) of the first cam (47) positions between the center of rotation and the horizontal bar portion (27) so that the first cam (47) is arranged to press the contacting surface (28*a*) rearward. When the rear end of the bottom edge (48*a*) exceeds the position as above, counter power which is caused by pressing of the first cam (47) against the contacting surface (28*a*) promotes detachment of the tops of the clipping members (1 and 21) and maintains the opening condition of the relative tops. At this time, the second actuation cam (48) is arranged as non-contacting condition, wherein the rear end (48*b*) of the second cam (48) contacts onto the interference block (9).

Figure 8:
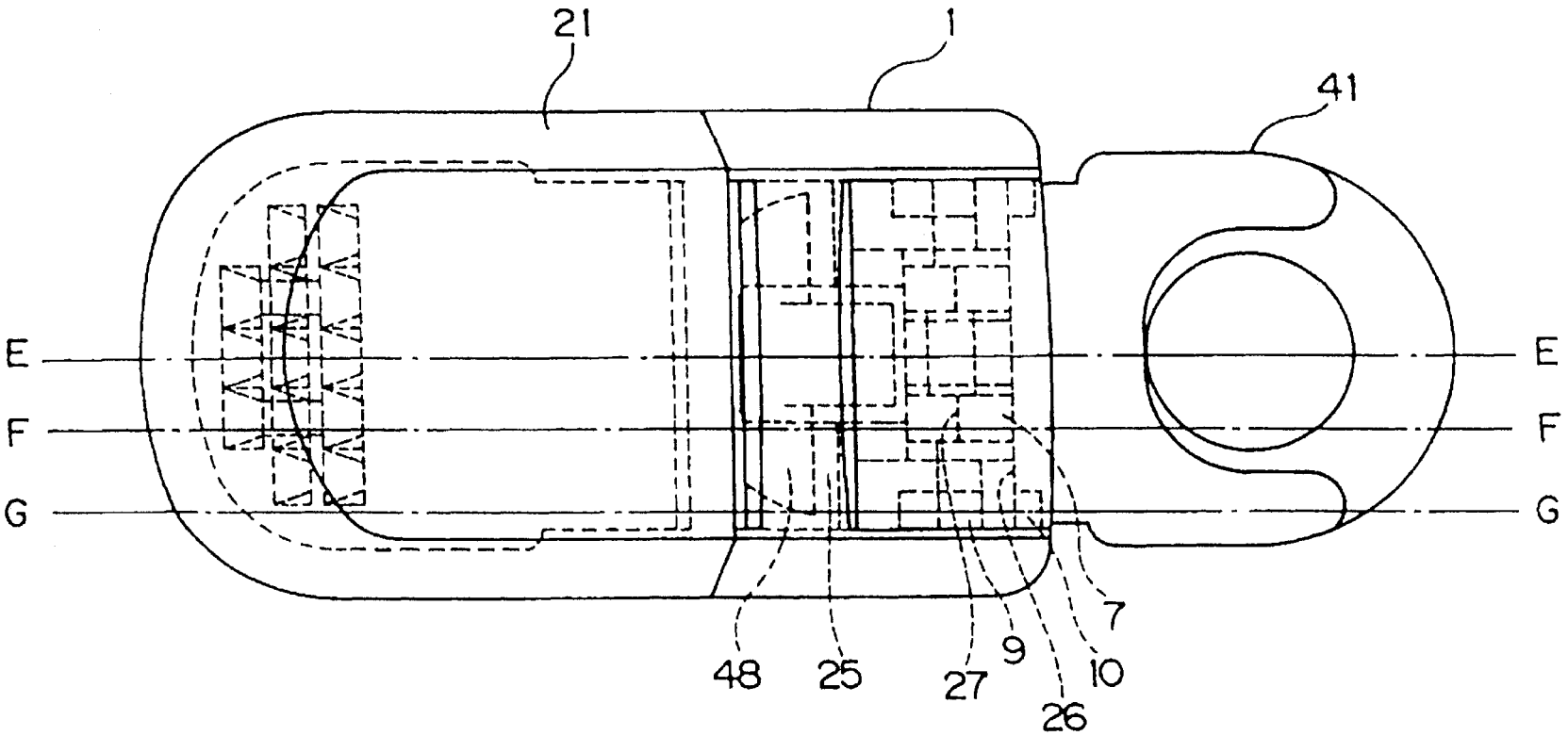
FIG. 8 is plan view of the plastic clip developed by this invention, wherein the upper clipping member and the operation member is assembled with the lower clipping member and the operation member is shown in a flat condition.

The measurements in the present embodiment for the upper clipping member (21) are about 25 mm long by 15 mm wide, while those for the lower clipping member (1) are about 27 mm long by 15 mm wide. As shown in FIG. 8, when the clip is closed, the thickness for the latter half is about 7 mm and the total length including the operation member (41) is preferably about 39 mm.

With regard to the material to be adopted in this invention for producing all substrates and other parts, it is not specially limited, but it is recommended to use polycarbonate resin in view of its elasticity and durability.

Now, the assembling procedures are explained.

FIG. 8 shows a plan view of a plastic clip view, where the upper clipping member (21) and the operation member (41) is assembled with the lower clipping member (1) and the operation member (41) is in a closed condition. In this figure, all three members (1,21 and 41) are shown in perspective. A line E—E runs lengthwise in the center of the clip, and the line F—F runs through the plain surface of the lower clipping member (1), the projecting portions of the upper clipping member (21), the horizontal bar portion (27) and the second cam (48) of the operation member (41), while the line G—G runs through the interference block (9), the claw (10) and the second cam (48).

Figure 9:
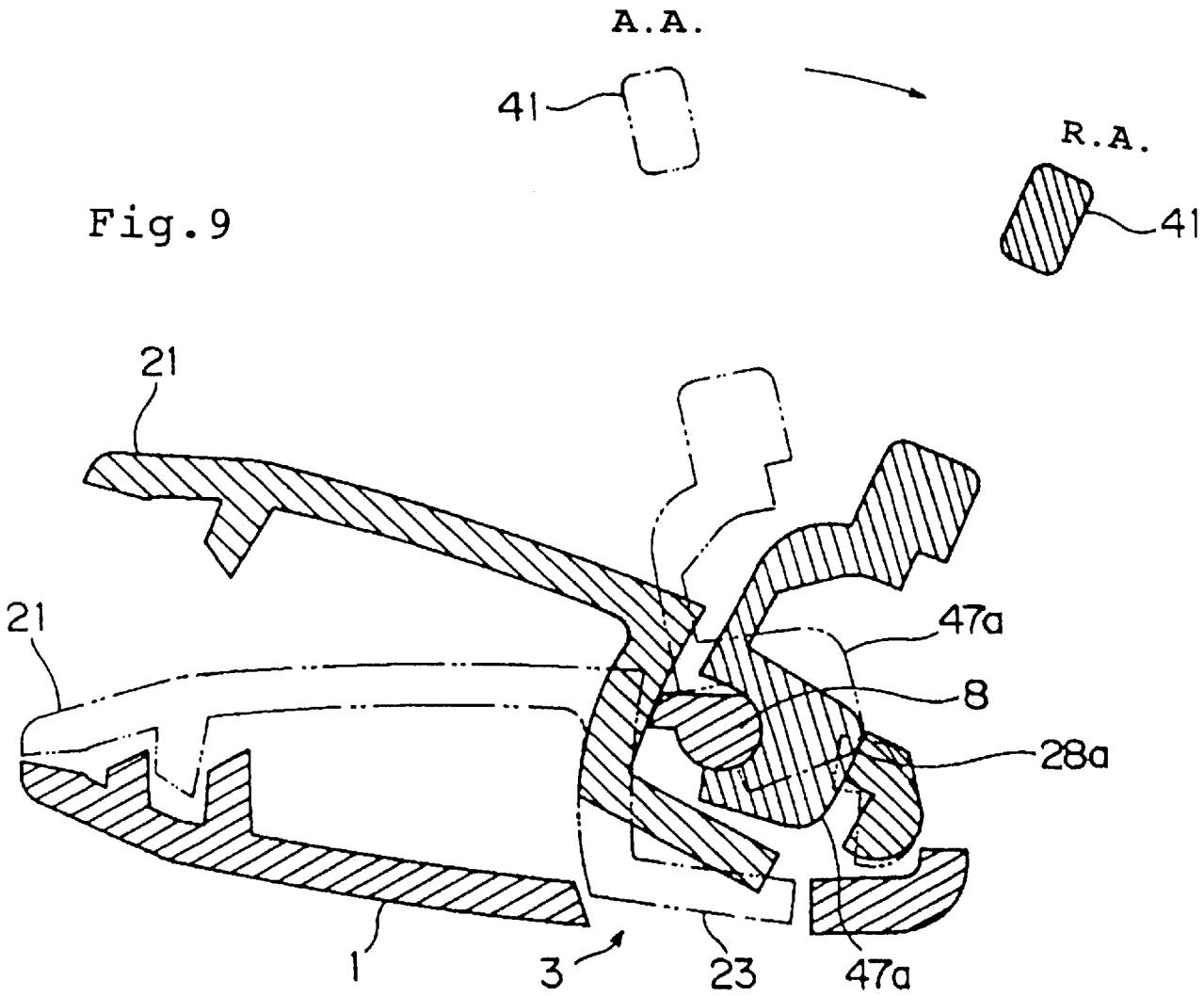
FIG. 9 is a longitudinal sectional view of the assembled three members along the line E—E of FIG. 8, wherein the connection between the upper clipping member and the operation member is shown at an acute angle (A.A.) and at a right angle (R.A.) respectively.
Figure 10:
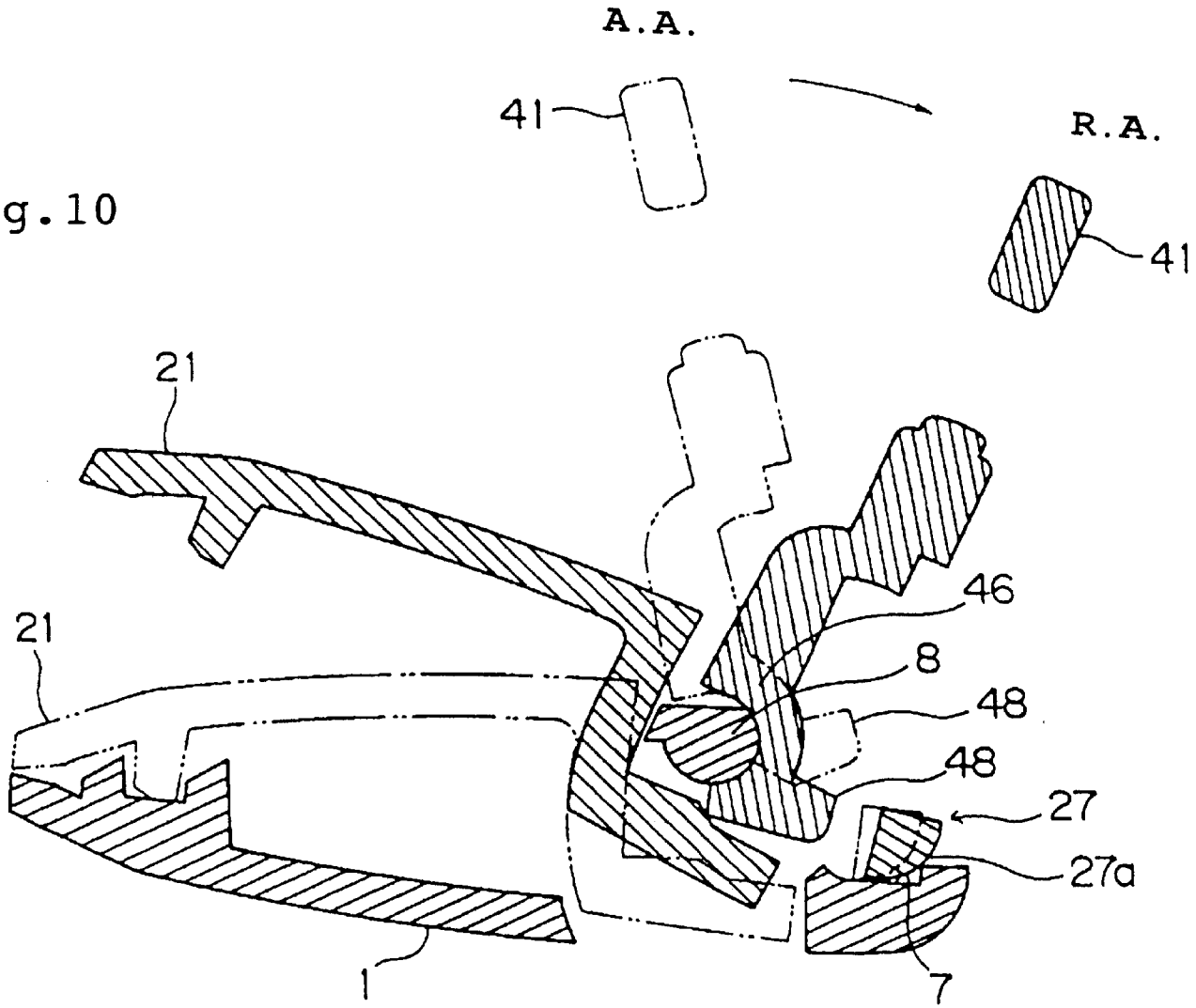
FIG. 10 is a longitudinal sectional view of the assembled three members along the line F—F of FIG. 8, wherein the connection between the upper clipping member and the operation member is shown at A.A. and at R.A. respectively.
Figure 11:
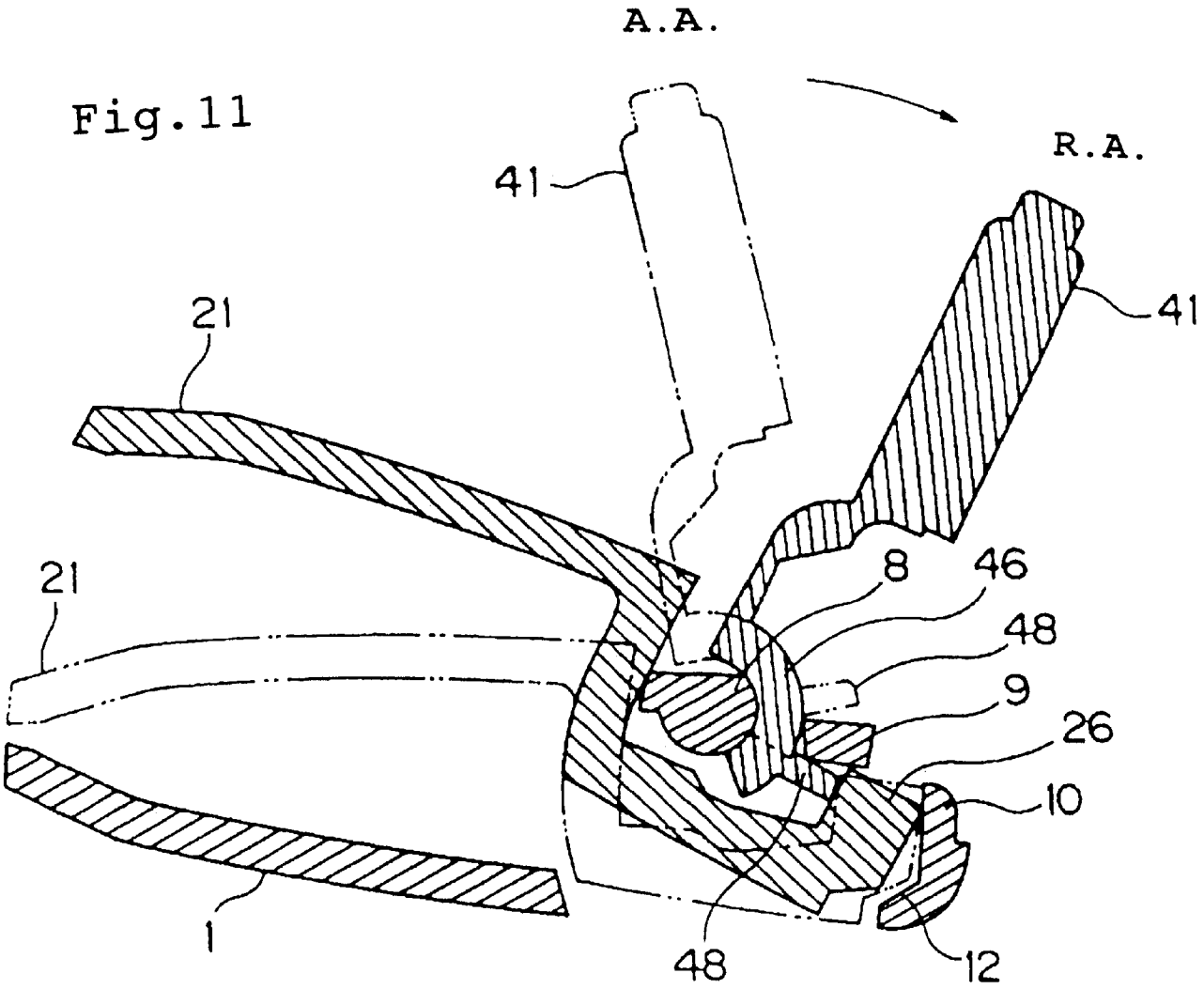
FIG. 11 is a longitudinal sectional view of the assembled three members along the line G—G of FIG. 8, wherein the connection between the upper clipping member and the operation member is shown at A.A. and at R.A. respectively.
Figure 12:
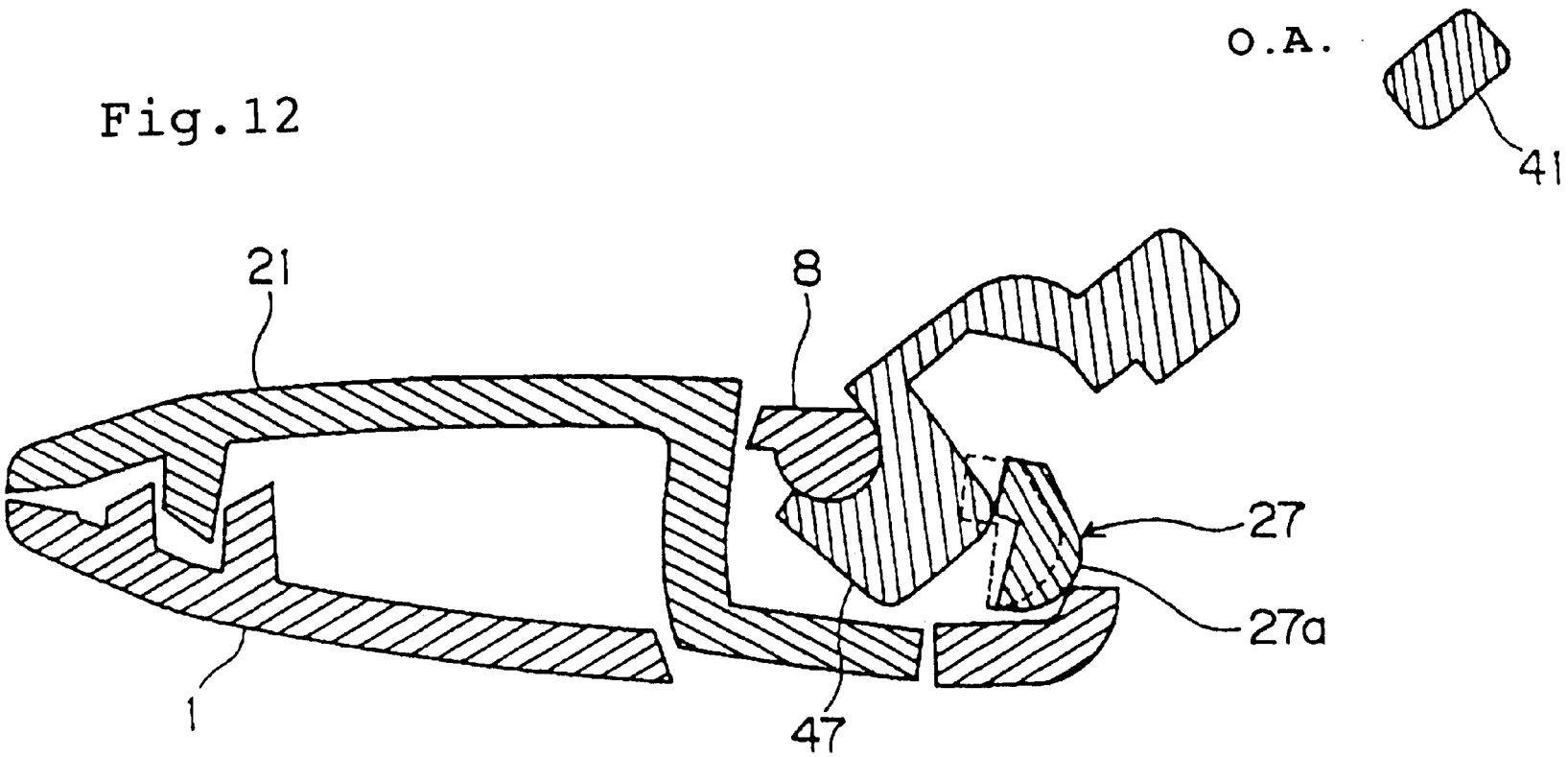
FIG. 12 is a longitudinal sectional view of the assembled three members along the line E—E of FIG. 8, wherein the connection between the upper clipping member and the operation member is shown at an obtuse angle (O.A.) respectively.

With regard to FIG. 9, R.A. means an angle connection between the operation member (41) and the upper clipping member (21) at a right angle, while A.A. means the same connection at an acute angle. As shown in FIG. 9, in the manner indicated by the dotted line, the auxiliary plate (13) of the upper clipping member (21) is inserted into the lower portion of the support axis (8) from the front of the lower clipping member (1) and the plate (13) is fitted into the fitting window (3) of the lower clipping member (1). As shown in FIG. 10, in the manner indicated by the dotted line at A.A., the arcuate surface (27*a*) of the horizontal bar portion is contacted and placed onto the plane surface (7) of the support shelf (6). Then, as shown by the dotted line of FIG. 9, the axis receiver (46) of the operation member (41) is inserted into the support axis from the rear portion of the upper clipping member (21), and the operation member (41) is turned downward on the center of the support axis (8). At this moment, as shown in FIG. 11, the front end of the bottom end (47*a*) meets onto the front portion of the contacting surface (28*a*), and the side surface of the second cam (48) contacts on the inner surface of the interference block (9) in the frictional manner. The operation member (41) moves to the position of R.A. as shown in FIG. 9, and further the operation member (41) is turned downward. At the place of the bottom end (47*a*), the projection (28) of the horizontal bar portion (27) is pushed rearward so that the bar horizontal portion (27) is urged to be transformed. As shown in FIG. 11, the side surface of the second cam (48) is inserted downward in the frictional manner against the inner surface of the interference block (9). With reference to FIG. 12, by this movement, the first actuation cam (47) comes into a gap formed between the support shelf (6) and the support axis (8) in the condition that the axis (46) is effectively inserted into the support axis (8). Thus, the operation member (41) is finally assembled with the lower clipping member (1) and with the upper clipping member (1). The mark O.A. in FIG. 12 means the angle connection between the operation member (41) and the upper clipping member (21) at an obtuse angle.

After the operation member (41) is assembled therewith, even if the operation member (41) is turned round forward, the assembly is not released because the bottom edge (48) of the second cam (48) firmly contacts and connects with the interference block (9) as shown in the condition of R.A. of FIG. 11.

Now, the actual operation is explained.

As shown in the condition of R.A. of FIG. 9, the rear end of the bottom end (47*a*) is positioned above the position which exists between the rotation center and the horizontal bar portion (27), and the bottom end (47*a*) is pressed onto the contacting surface (28*a*) of the projection (28). Then, the contacting surface (28*a*) on the horizontal bar portion (27) is pressed rearward. As shown in FIG. 10, the arcuate surface (27*a*) is now contacted on the plain surface (7) of the support shelf (6) and the horizontal bar portion (27) is transformed. In this situation, the second cam (48) remains in the no contact position, whereas counter force caused by pressing action of the first cam (47) to the contacting surface (28*a*) rearward produces a counter-clockwise physical moment in the direction shown in FIG. 9, and therefore the force is obtained to maintain the top ends of the lower clipping member (1) and of the upper clipping member (21) opened. As shown in FIG. 10, the top end of the upper clipping member (21) closes on the center of the horizontal bar portion (27) until the protuberance (25) contacts on the top end of the operation member (41). As shown in FIG. 11, the rear end (48*b*) of the second cam (48) contacts onto the interference block (9) to maintain the plastic clip open and at the same time the tight assembly of the three members (1,21 and 41) is maintained.

Figure 13:
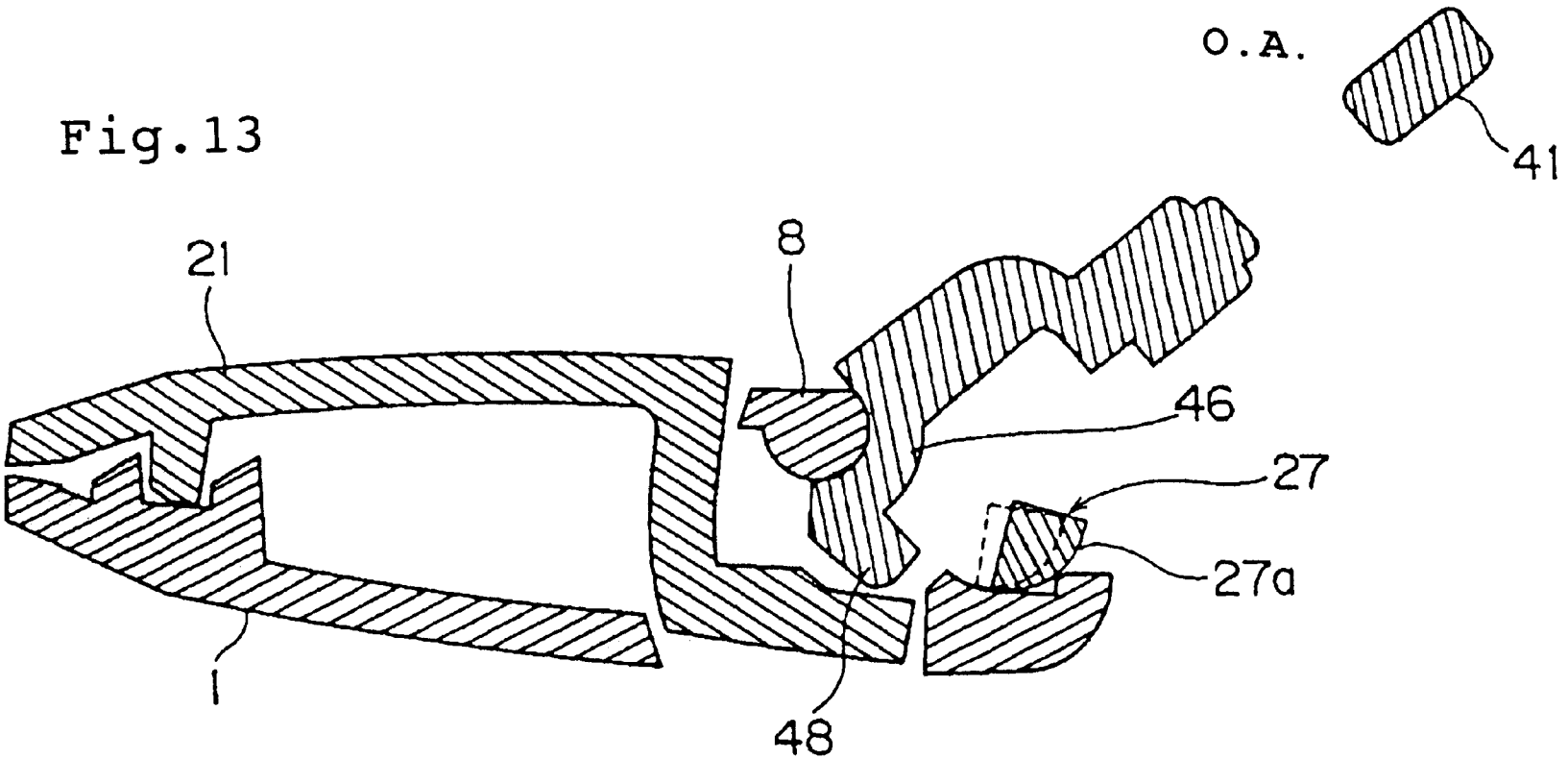
FIG. 13 is a longitudinal sectional view of the assembled three members along the line F—F of FIG. 8, wherein the connection between the upper clipping member and the operation member is shown at O.A. respectively.
Figure 14:
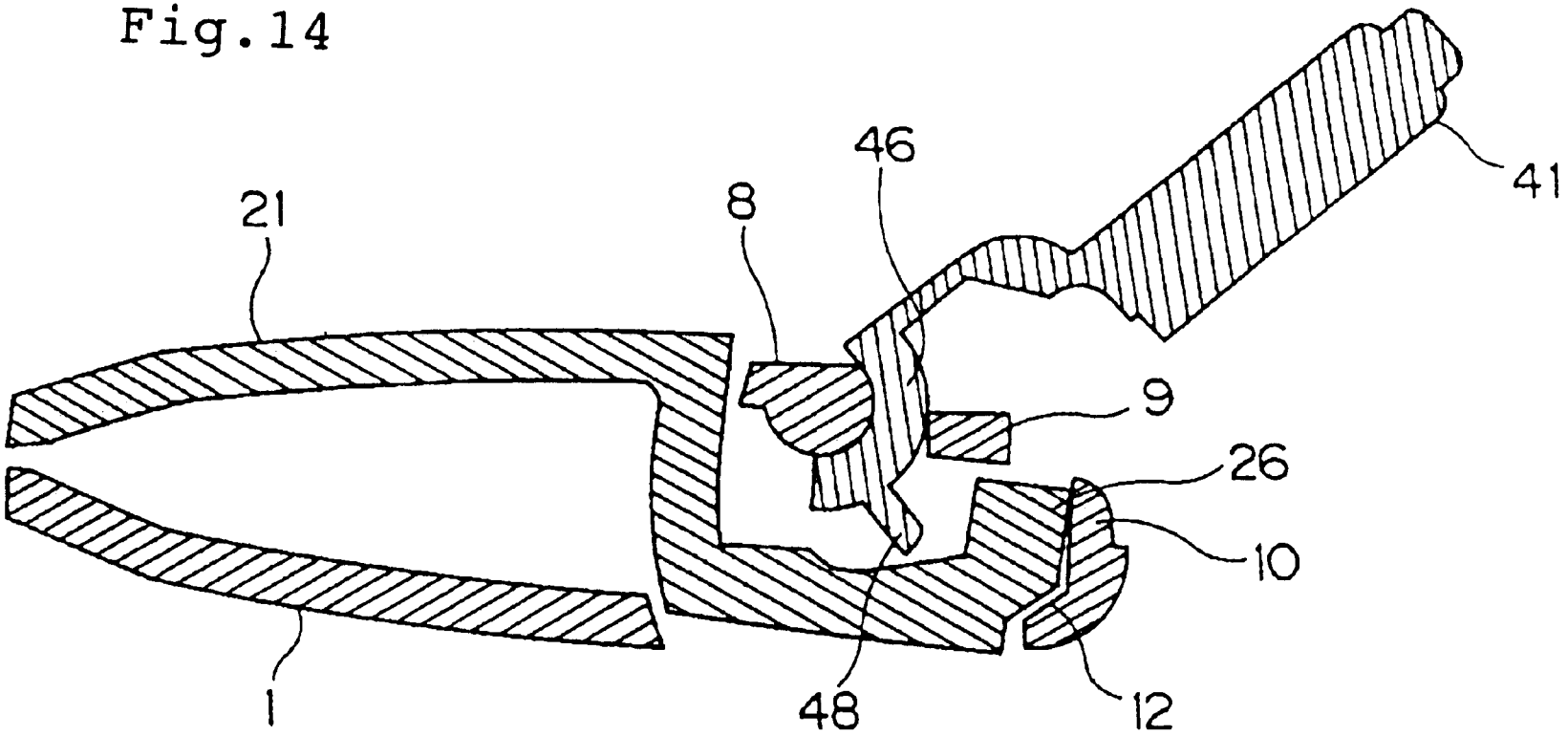
FIG. 14 is a longitudinal sectional view of the assembled three members along the line G—G of FIG. 8, wherein the connection between the upper clipping member and the operation member is shown at O.A. respectively.

When a material is inserted between the top ends of the lower clipping member (1) and of the upper clipping member (21) and the operation member (41) is turned downward as shown in FIG. 12~FIG. 14. The rear end of the bottom end (47*a*) is positioned on the line between the rotation center and the horizontal bar (27) center. Then, the second cam (48) releases from the noncontact condition and the bottom edge (48*a*) presses the protuberance (25). The rear end of the bottom end (47*a*) exceeds the line as mentioned and the front end of the bottom edge (48*a*) rides on the upper platform (25*a*) and positions on the lower place of the rotation center, and thus the protuburence (25) is pressed downward to invite the condition where the top ends of the lower clipper member (1) and of the upper clipper member (21) are closed. At this time, the first cam (47) is in the noncontact condition and the horizontal bar (27) remains as had. When the front ends of the bottom edge (48*a*) exceed the lower place of the rotation center, as the first cam (47) is in the noncontact condition, the physical moment for a clockwise direction occurs in the second cam (48), whereas the force maintains the closing condition between the lower clipping member (1) and the upper clipping member (21). Thus, the closing condition is ensured.

Figure 15:
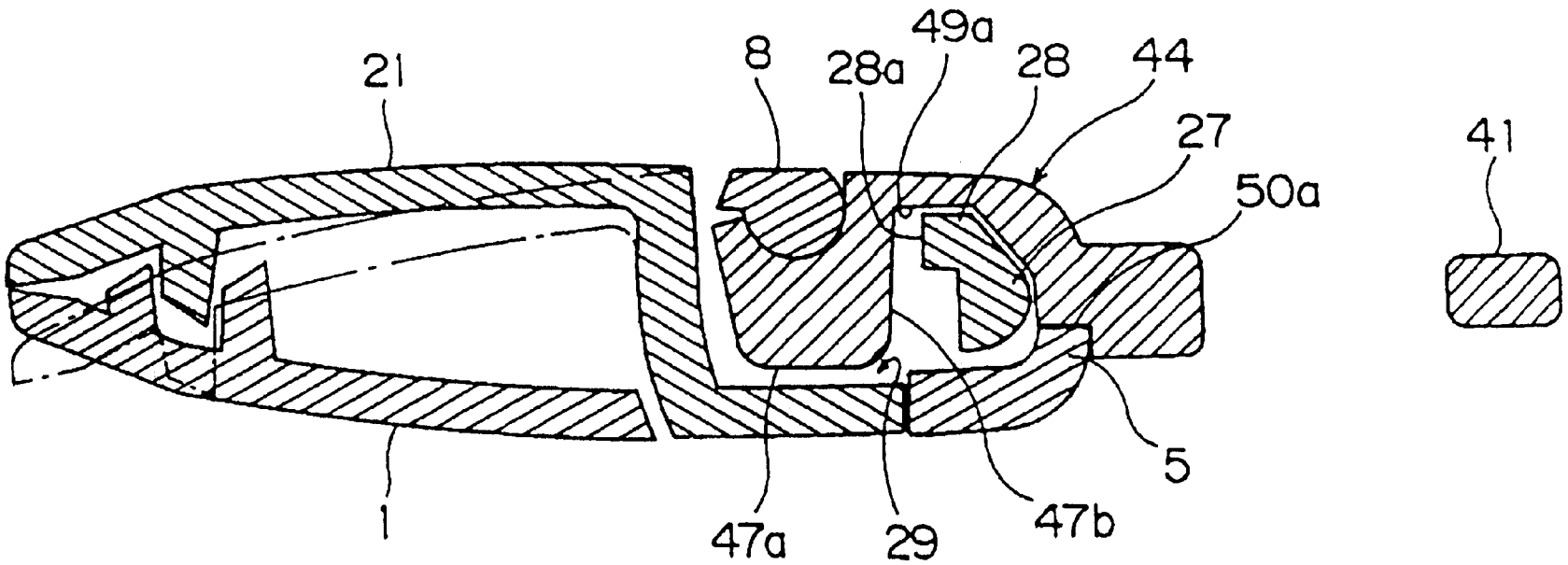
FIG. 15 is a longitudinal sectional view of the assembled three members along the line E—E of FIG. 8.
Figure 16:
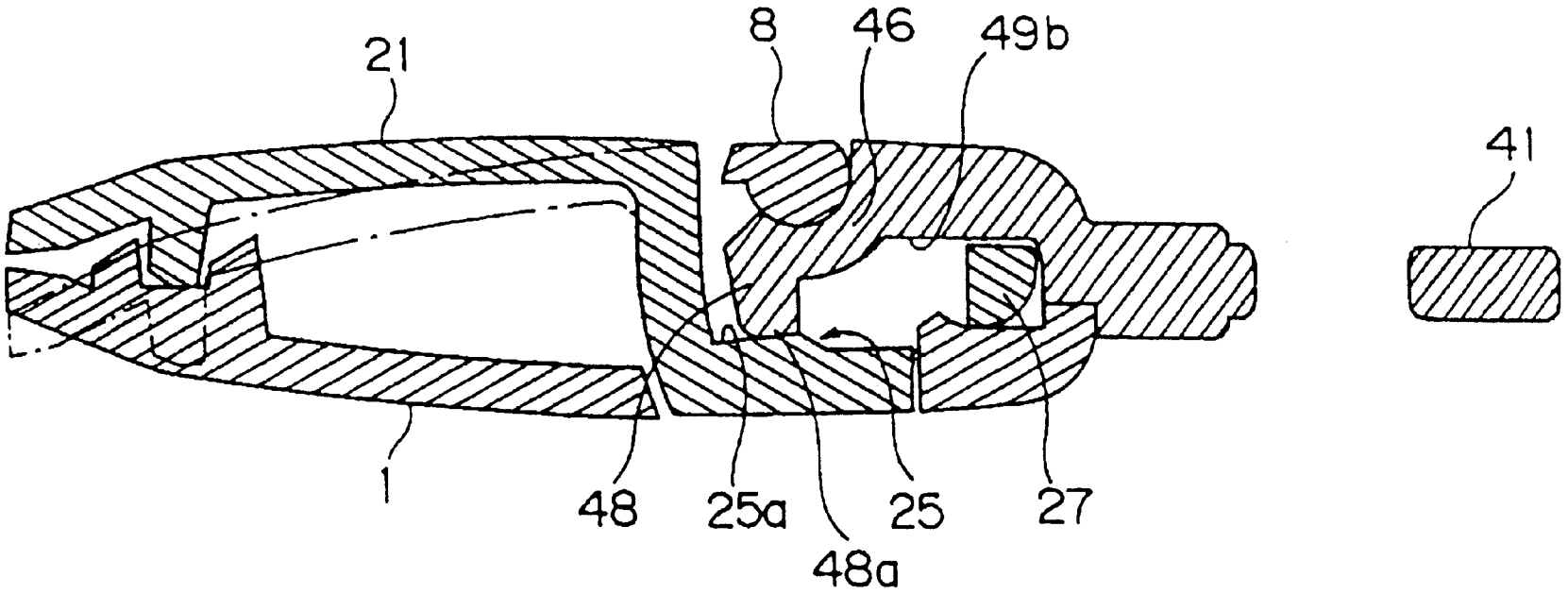
FIG. 16 is a longitudinal sectional view of the assembled three members along the line F—F of FIG. 8.
Figure 17:
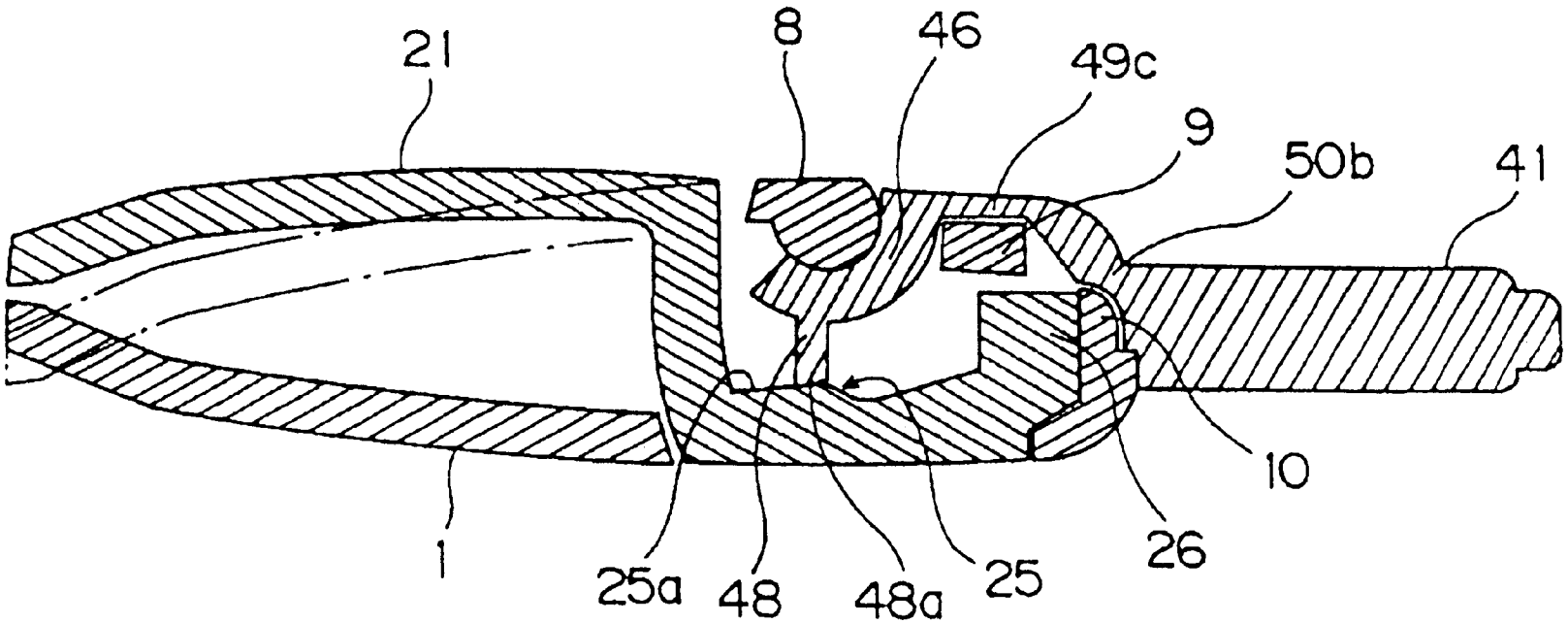
FIG. 17 is a longitudinal sectional view of the assembled three members along the line G—G of FIG. 8.
Figure 18A:
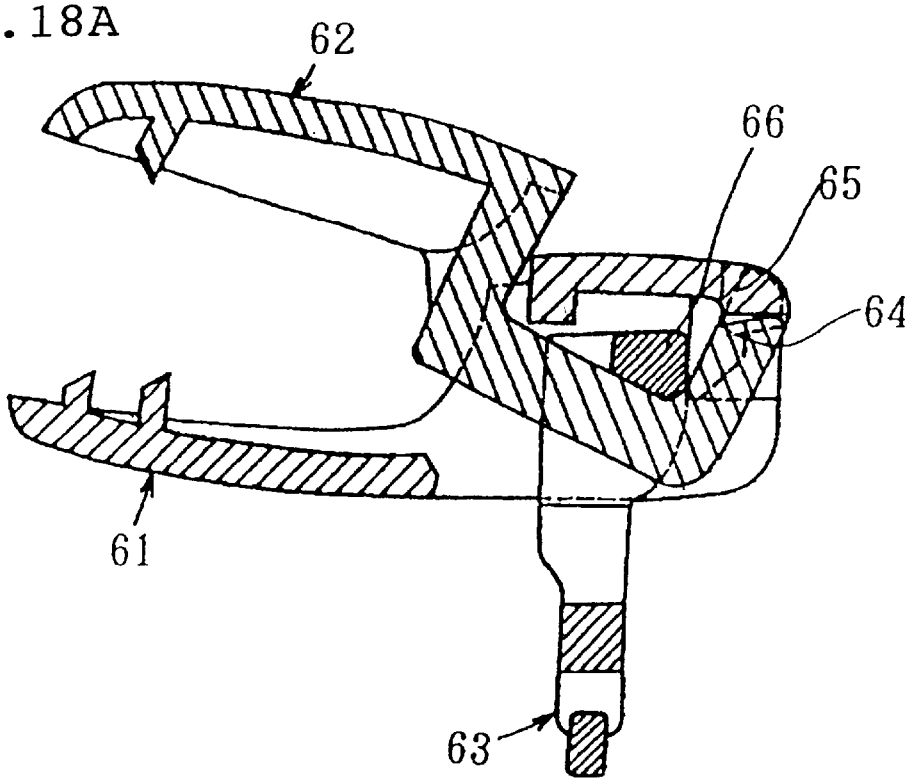
PRIOR ART Fig.18A
FIG. 18A is a longitudinal sectional view of a prior art clip, showing a condition when the clip is opened.
Figure 18B:
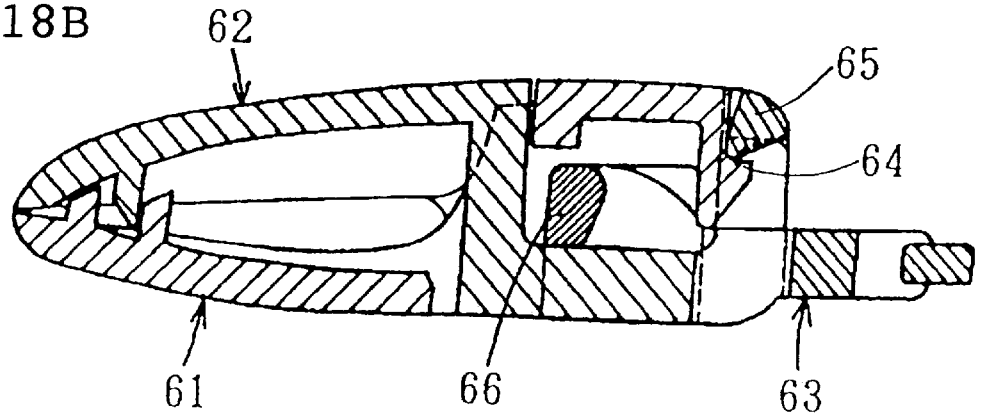
FIG. 18B is a longitudinal sectional view of a prior art clip, showing a condition when the clip is closed.
Figure 19A:
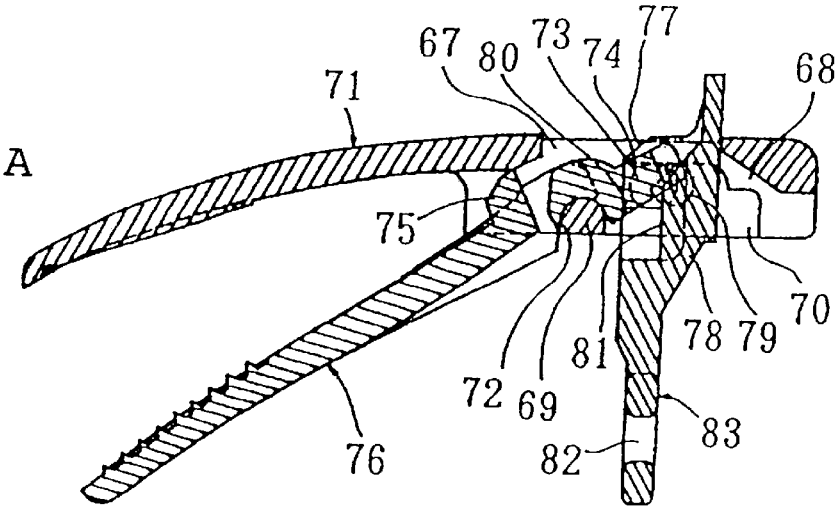
PRIOR ART Fig.19A
FIG. 19A is a longitudinal sectional view of another prior art clip, showing a condition when the clip is opened.
Figure 19B:
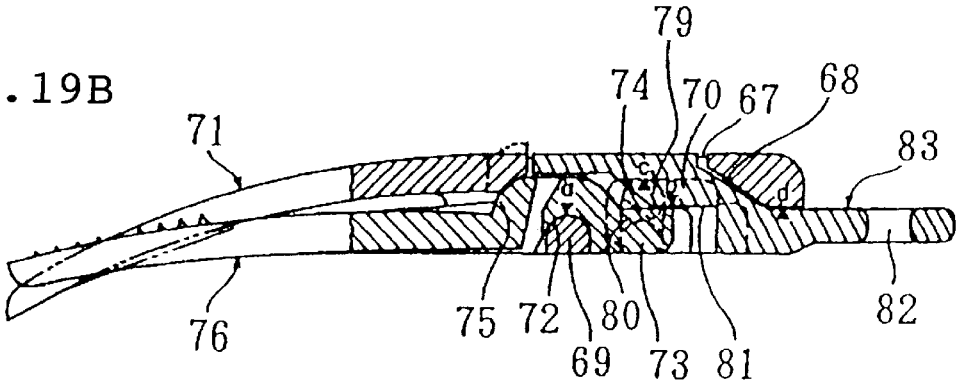
FIG. 19B is a longitudinal sectional view of another prior art clip, showing a condition when the clip is closed.

As shown in FIG. 8, the operation member (41) shows a level condition. Referring to FIG. 15, one side ditch (50*a*) of the operation member (41) fits onto the rear wall (5) of the lower clipping member (1), and the bottom surface of the one side ditch (50*a*) contacts onto the upper surface of the rear wall (5). The projection (28) of the upper clipping member (21) fits into a central portion (49*a*) of a middle plate (49) and the inner surface of the central portion (49*a*) stays on the outer surface of the projection (28) with a gap as shown in FIG. 15. As shown in FIG. 16, a lower surface of an adjoining portion (49*b*) in the central portion (49*a*) stays above on the upper surface of the horizontal bar portion (27). As shown in FIG. 17, the back surface of the rear wall (26) contacts onto the front surface of the claw (10) and onto the declined surface of the sloped shelf (12), while an end portion (49*c*) in the central portion (49*a*) stays on the upper surface of the interference block (9) with a gap and an end (50*b*) of the rear wall (50) is inserted into the claw (10) with a gap.

As shown in FIG. 15, between the back surface (47*b*) of the first cam (47) and the contacting surface (28*a*) of the projection (28) a gap is formed, and therefore even if the closing condition continues, hysteresis wear on the horizontal bar portion (27) is avoided.

When the operation member (41) is assembled, the bottom end (48*a*) makes some frictional contact with the interference block (9), but this friction is overcome by movement caused between the side of the second cam (48) and the bottom end (48*a*).

In the present invention, the lower clipping member (1) and the upper clipping member (21) are assembled at their rear areas and fulcrum point of the opening is kept in the vicinity of the rear area, whereas larger opening angle for the clip can be obtained. When the top ends of the clip are closed, a gap is secured between the back surface (47*b*) and the contacting surface, so that the hysteresis wear of the horizontal bar portion (27) is avoided.

With regard to the lower clipping teeth (13) and the upper clipping teeth (30) adopted in this invention, elastic rubber plates may be used.

The support axis (8) can be formed on the inner surface of the side wall (4), and the axis receiver (46) can be formed on the upper surface of the front wall (45), while the support shelf (6) can be formed on the rear wall (5).

According to the present invention, the lower clipping member (1) and the upper clipping member (21) are assembled at the rear area, and the horizontal bar portion (27) is also positioned at the rear area, whereas larger opening angle in comparison with total length of the clip can be attained in.

In this invention, a separate spring means for opening or closing the clip is not adopted, and the property of the plastic material is utilized instead, so that the assembly becomes very simple and economical due to the smaller number of parts and reduced assembly time.

The fitting window (3) is filled with the auxiliary plate (23) and the outer appearance of the present completed clip has a flat and smooth surface as completed goods. Therefore, the design is very thin and smart with good ergonomics.

It is further understood by those skilled in the art that the foregoing description is preferred embodiment of the disclosed goods and that various changes and modifications may be made in this invention without departing from the spirit and scope thereof.

What is claimed is:

1. A method of operating a plastic clip having a lower clipping member, an upper clipping member and an operation member, which comprises:

providing a recessed auxiliary plate prepared in the upper clipping member;

providing a fitting window prepared in the lower clipping member;

inserting the upper clipping member into the fitting window;

providing a horizontal bar portion to be placed on a support shelf;

providing an axis receiver in the operation member;

providing an axis support formed in a side wall of the lower clipping member;

fitting the axis receiver into the axis support; and wherein when the receiver is forcibly pressed downward, both the ends of the lower and upper clipping members are pinched together by the elastic power of a plastic material for a closed position while when the rear area of the operation member is moved upward and a contacting surface of a projection is pressed forcibly toward the rear at a bottom end of a first actuation cam, an open position is caused between the lower and upper clipping members thereof by the force of a fulcrum function of the horizontal bar portion.

2. A method of operating a plastic clip having a lower clipping member, an upper clipping member and an operation member, which comprises:

opening or closing top end portions of the lower clipping member and the upper clipping member by movement of the operation member wherein the lower clipping member on which an upper clipping member is placed, and the operation member are assembled with the upper clipping member;

providing a pair of side walls facing each other prepared on a rear area of the lower clipping member;

providing a rear wall having a support shelf established in its rear area;

providing a fitting portion formed on the inner surfaces of the side walls and in front of the support shelf, so that the operation member may move up and down in the portion;

providing a recessed auxiliary plate established on the rear area of the upper clipping member;

providing a rear wall of the recessed auxiliary plate formed in a horizontal bar shape portion to be placed on the support shelf;

providing a plane surface formed on the front part of the horizontal bar shape portion;

providing a receiver portion for accepting the fitting portion formed in front and upper portion of the operation member;

assembling the receiver portion with the fitting portion;

alligning the lower clipping member and the operation member into a same direction;

forming a first actuation cam in an extending shape, which is adapted to press the plane surface portion rearward towards the rear rotation center of the operation member;

forming a second actuation cam in an extending downward shape, which is adapted to press the upper surface of the auxiliary plate downward in a portion below the rotation center;

causing a force to mainain a closing condition in the front area of the rotation center from the lower portion, when the second actuation cam is positioned to just below the rotation center, where the cam presses the upper faces of the auxiliary plate downward so that both tops of the lower clipping member and the upper clipping member are closed; and causing another force to maintain an opening condition between each top of the lower clipping member and the upper clipping member by force of the horizontal bar shape portion produced while the first actuation cam presses a plane surface of the horizontal bar shape portion backward, when the second cam is positioned to stay to the rear of the lower portion and the first cam is positioned to stay in an upper area between the rotation center and the horizontal bar shape portion.

3. A plastic clip having a lower clipping member, an upper clipping member and an operation member, the clip comprising:

the lower clipping member on which the upper clipping member is placed, and the operation member which is assembled with the upper clipping member, wherein both end portions of the lower clipping member and the upper clipping member are opened or closed by movement of the operation member;

a pair of side walls facing each other on a rear area of the lower clipping member;

a rear wall having a support shelf established in a rear wall of a rear area;

a fitting portion formed on inner surfaces of the side walls and in front of the support shelf, wherein the operation member may move up and down in the fitting portion;

a recessed auxiliary plate established on a rear area of the upper clipping member;

a rear wall of the recessed auxiliary plate formed in a horizontal bar shape portion placed on the support shelf;

a plane surface portion formed on a front part of the horizontal bar shape portion;

a receiver portion axis receiver for accepting a fitting portion formed in front and upper portion of the operation member;

the receiver portion assembled with the fitting portion;

wherein the lower clipping member and the operation member are aligned into a same direction;

a first actuation cam formed in an extending shape, which is adapted to press the plane surface portion rearward behind a rotation center for the operation member;

a second actuation cam formed in an extending downward shape, which is adapted to press an upper surface of the recessed auxiliary plate downward in a lower portion than the rotation center;

a force which maintains a closing condition in the front area of the rotation center from the lower portion, when the second actuation cam is positioned into just below the rotation center, where the cam presses upper faces of the recessed auxiliary plate downward so that both tops of the lower clipping member and the upper clipping member are closed; and another force which maintains an opening condition between each top of the lower clipping member and the upper clipping member by a counter force produced by the horizontal bar shape portion while the first actuation cam presses the plane surface of the horizontal bar shape portion backward, when the second cam is positioned to stay in a rear area of the lower portion and the first cam is positioned to stay in upper area between the rotation center and the horizontal bar shape portion.

4. According to claim 3, a plastic clip having a lower clipping member, an upper clipping member and an operation member, wherein a fitting portion formed on the lowr clipping member and a relative receiver portion formed on the operation member so that the proper fitting is smoothly attained therebetween while the fitting portion comprises a support axis and the receiver portion comprises a receiver.

5. A plastic clip wherein top ends of a lower clipping member and an upper clipping member are operated or closed by rotating of the clip operation member comprising:

a fitting window prepared on a rear area of the lower clipping member where the fitting window has two side surfaces;

a pair of side walls established on both side surfaces of the window;

a rear wall formed lower than the side wall;

a support shelf extending forward in a front direction of the lower clipping member on the front surface of the rear wall;

a pair of support axes established in inner surfaces of the side walls in an upper and a front position of the shelf;

a pair of interference blocks formed on the inner surfaces the side walls positioned between the support axis and the support shelf in a lower position than the support axis;

a recessed auxiliary plate prepared in an arcuate shape adapted to be inserted in the fitting window in the rear area of the upper clipping member;

a protuberance established on both upper surfaces of a bottom of the recessed auxiliary plate, which runs toward the upper surfaces;

a pair of rear walls established as standing on the auxiliary plate;

a horizontal bar portion formed between the rear walls, having an arcuate surface facing on a plane surface of the support shelf and a contacting surface directed forward;

a strap insertion hole formed in a rear area of the operation member;

a back plate formed in a front area of the operation member;

an axis receiver having an arcuate shape on the upper surface of a rear wall of the back plate, adapted to be rotatably inserted around the support axis;

a first actuation cam established on a lower surface of a front wall so that a bottom end may contact and press onto a contacting surface of a projection;

a pair of bottom edges formed on both sides of the first actuation cam so that the bottom end contacts and presses onto the protuberance;

a pair of second actuation cams established so that a pair of rear ends correspond with the pair of the interference blocks;

wherein the auxiliary plate of the upper clipping member is placed onto the lower position of the support axis of the lower clipping member and then is pushed into the fitting window and the horizontal bar portion of the upper clipping member is placed on the support shelf and then the arcuate axis receiver of the operation member is fitted into the support axis of the lower clipping member, and with this fitting condition the front wall of the operation member is forcibly pushed into the underside of the support axis from the rear side of the upper clipping member, and when the operation member is rotated centering around the support axis so that the second actuation cam of the operation member may position below the rotation center, the protuberance of the auxiliary plate is pressed downward to cause the top ends of both clipping members as closed;

wherein a force to maintain the closing movement can be obtained when the second actuation cam is positioned in the area ahead of the rotation center;

wherein another force maintains the opening movement when the second cam is positioned behind the area from the rotation center and also is positioned higher than the place between the rotation center and the horizontal bar portion in which counter force of the horizontal bar portion works to detach both top ends of the both clipping members and wherein assembly of the lower clipping member, the upper clipper member and the operation member can be ensured because the rear ends of the second actuation cam contact on the interference block so that each member may not be detached.

6. A plastic clip according to claim 5, wherein a support axis is formed along between both walls of a lower clipping member and a axis receiver in an arcuate shape is formed crossing over a front wall of a back plate.

7. A plastic clip according to claim 5, wherein a gap is formed between the first actuation cam of the operation member and a contacting surface of the upper clipping member to prevent histeresis wear when both top ends of a lower clipping member and of an upper clipping member are closed.

* * * * *